US009428987B2

(12) United States Patent
Corre et al.

(10) Patent No.: US 9,428,987 B2
(45) Date of Patent: Aug. 30, 2016

(54) SINGLE PACKER WITH A SEALING LAYER SHAPE ENHANCED FOR FLUID PERFORMANCE

(71) Applicant: Schlumberger Technology Corporation, Sugar Land, TX (US)

(72) Inventors: Pierre-Yves Corre, Abbeville (FR); Jean-Louis Pessin, Amiens (FR); Julian J. Pop, Houston, TX (US); Stephane Metayer, Abbeville (FR); Kathiravane Tingat Cody, Amiens (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 579 days.

(21) Appl. No.: 13/666,411

(22) Filed: Nov. 1, 2012

(65) Prior Publication Data

US 2014/0116718 A1 May 1, 2014

(51) Int. Cl.

| | |
|---|---|
| ***E21B 49/00*** | (2006.01) |
| ***E21B 33/127*** | (2006.01) |
| ***E21B 49/08*** | (2006.01) |

(52) U.S. Cl.

CPC ..... *E21B 33/1277* (2013.01); *E21B 49/081* (2013.01)

(58) Field of Classification Search

CPC .. E21B 49/08; E21B 49/081; E21B 33/1208; E21B 33/124; E21B 33/1243; E21B 33/127

See application file for complete search history.

(56) References Cited

U.S. PATENT DOCUMENTS

| | | | | |
|---|---|---|---|---|
| 2,613,747 | A * | 10/1952 | West | E21B 49/10 166/100 |
| 2,843,208 | A * | 7/1958 | Blood | E21B 33/1243 166/100 |
| 5,353,871 | A | 10/1994 | Eslinger et al. | |
| 5,390,738 | A | 2/1995 | Eslinger et al. | |
| 5,439,053 | A | 8/1995 | Eslinger et al. | |
| 5,507,341 | A | 4/1996 | Eslinger et al. | |
| 5,549,159 | A * | 8/1996 | Shwe et al. | 166/250.02 |
| 5,613,555 | A | 3/1997 | Sorem et al. | |
| 5,909,773 | A | 6/1999 | Koehler et al. | |
| 6,865,933 | B1 | 3/2005 | Einarson et al. | |

(Continued)

FOREIGN PATENT DOCUMENTS

| | | |
|---|---|---|
| WO | 2009147564 A1 | 12/2009 |
| WO | 2012054865 A2 | 4/2012 |

OTHER PUBLICATIONS

International Search Report and the Written Opinion for International Application No. PCT/US2013/066602 dated Feb. 7, 2014.

(Continued)

*Primary Examiner* — Kenneth L Thompson
*Assistant Examiner* — Steven MacDonald
(74) *Attorney, Agent, or Firm* — Kenneth L. Kincaid

(57) ABSTRACT

A system and/or a method collects formation fluids using a single packer with expansion rings and/or an irregular sealing layer. The packer may have an expansion ring extending around an outer circumference. The expansion ring may seal a portion of a wellbore to sample fluid from a formation. An irregular sealing layer may facilitate leaking between drains of the packer. The irregular sealing layer may have grooves through which fluid may flow. The irregular sealing layer may be composed of fibers and/or plastic.

19 Claims, 4 Drawing Sheets

(56) References Cited

U.S. PATENT DOCUMENTS

| | | | | |
|---|---|---|---|---|
| 7,510,015 | B2 | 3/2009 | Corre et al. | |
| 7,721,799 | B2 | 5/2010 | Baski | |
| 7,823,636 | B2 | 11/2010 | Lucas | |
| 7,874,356 | B2 | 1/2011 | Corre et al. | |
| 8,113,293 | B2 | 2/2012 | Corre | |
| 2003/0075342 | A1 | 4/2003 | Gunnarsson | |
| 2004/0007829 | A1* | 1/2004 | Ross | 277/626 |
| 2007/0039731 | A1 | 2/2007 | Fox et al. | |
| 2007/0144734 | A1 | 6/2007 | Xu et al. | |
| 2010/0071898 | A1 | 3/2010 | Corre | |
| 2010/0122822 | A1* | 5/2010 | Corre | 166/387 |
| 2010/0294516 | A1 | 11/2010 | Corre et al. | |
| 2011/0067860 | A1 | 3/2011 | Corre et al. | |
| 2014/0096979 | A1 | 4/2014 | Corre et al. | |

OTHER PUBLICATIONS

Partial Supplementary European Search Report issued in related EP Application No. 13850498.0 mailed Jul. 6, 2016 (6 pages).

* cited by examiner

SINGLE PACKER WITH A SEALING LAYER SHAPE ENHANCED FOR FLUID PERFORMANCE

CROSS-REFERENCED TO RELATED APPLICATIONS

None.

FIELD OF THE INVENTION

The present disclosure generally relates to evaluation of a subterranean formation. More specifically, the present disclosure relates to a packer tool with a sealing layer.

BACKGROUND INFORMATION

For oil and gas exploration, information about subsurface formations that are penetrated by a wellbore is necessary. Measurements are essential to predicting production capacity and production lifetime of a subsurface formation. Collection and sampling of underground fluids contained in subterranean formations are well known. Moreover, testing of a formation may provide valuable information regarding the properties of the formation and/or the hydrocarbons associated therewith. In the petroleum exploration and recovery industries, for example, samples of formation fluids are collected and analyzed for various purposes, such as to determine the existence, composition and producibility of subterranean hydrocarbon fluid reservoirs. This aspect of the exploration and recovery process is crucial to develop exploitation strategies and impacts significant financial expenditures and savings.

A variety of packers are used in wellbores to isolate specific wellbore regions. A packer is delivered downhole on a tubing string, and a packer sealing element is expanded against the surrounding wellbore wall to isolate a region of the wellbore. The sealing layer of the sealing element is typically a uniformly-surface, cylindrical layer of rubber/elastomer. Often, two or more packers may be used to isolate several regions in a variety of well related applications, including production applications, service applications and testing applications.

Isolating a particular section of a wellbore typically involves deploying a dual packer system. Deploying a dual packer system is more involved than deploying a single packer since a greater likelihood that one packer may fail exists. Therefore, a single packer is desired which may be deployed in a formation to isolate a portion of the wellbore.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

Aspects generally relate to a system and method for collecting formation fluids using a single packer with rings and/or an irregular sealing layer. Use of the single packer with rings enables larger expansion ratios and higher draw-down pressure differentials. Additionally, the single packer configuration reduces the stresses otherwise incurred by the packer tool mandrel due to the differential pressures. In at least some embodiments, the single packer may support the formation in hydrocarbon-yielding zone at which formation fluids are collected. The single packer configuration facilitates relatively large amplitude draw-downs even in weak, unconsolidated formations.

The single packer expands across an expansion zone, and formation fluids can be collected from the middle of the expansion zone, i.e. between axial ends of the single packer. The formation fluid is collected and directed along flow lines, e.g. along flow tubes, from the one or more drains. For example, separate drains can be disposed along the length of the packer to establish collection intervals or zones that enable focused sampling at a plurality of collecting intervals, e.g. two or three collecting intervals. Separate bowlines can be connected to different drains, e.g. sampling drains and guard drains, to enable the collection of unique formation fluid samples.

The single packer provides a simplified packer structure that facilitates, for example, focused sampling. The outer flexible layer may also be used to contain drains, such as groups of drains in which a middle group has sampling drains and two axially outer groups have guard drains. The drains may be coupled to the bowlines in a manner that facilitates expansion and contraction of the single packer.

Figure 1:
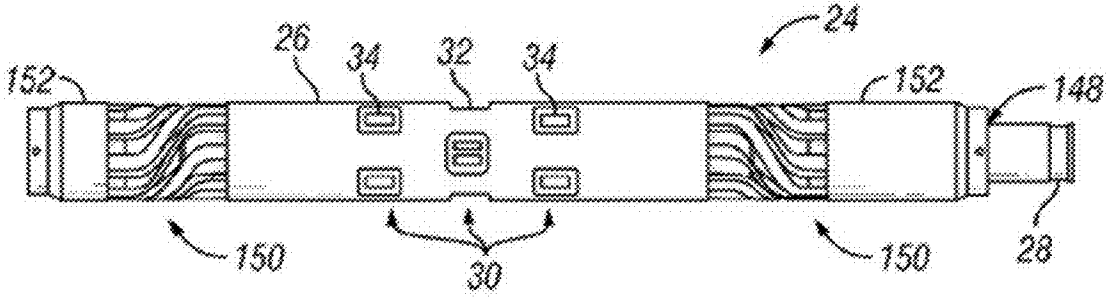
FIG. 1 Prior Art
FIGS. 1 and 2 generally illustrate a typical packer system of the prior art.

Referring now to FIG. 1, one embodiment of a typical packer assembly 20 of the prior art is illustrated as deployed in a wellbore 22. In this embodiment, the packer assembly 20 has an inflatable single packer 24 having an outer flexible skin 26 formed of expandable material, e.g. a rubber material, which allows for inflation of the packer 24. The outer flexible skin 26 is mounted around a packer mandrel 28 and has openings for receiving drains 30. By way of example, the drains 30 may have one or more sampling drains 32 positioned between guard drains 34. The drains 30 are connected to corresponding flow lines 36 for transferring fluid received through the corresponding drains 30. The flow lines 36 connected to the guard drains 34 may be separated from the flow lines 36 connected to the sample drains 32.

The packer 24 is a single packer having an outer layer formed of an outer flexible skin 26 made from an elastic material, e.g. rubber. The outer flexible skin 26 is expandable in a wellbore to seal with a surrounding wellbore wall. The single packer 24 has an inner inflatable bladder 148 disposed within the outer flexible skin 26. By way of example, the inner bladder 148 may be selectively expanded by introducing fluid via the interior packer mandrel 28. Additionally, the packer 24 has a pair of mechanical fittings 150 that may have fluid collectors 152 coupled with the flow lines 36. The mechanical fittings 150 are mounted around the inner mandrel 28 and engaged with axial ends of the outer flexible skin 26.

Referring to FIG. 1, the outer flexible skin 26 has openings for receiving the drains 30 through which formation fluid is collected when the outer flexible skin is expanded against a surrounding wellbore wall. The drains 30 may be embedded radially into the outer flexible skin 26. A plurality of the flow lines 36 may be operatively coupled with the drains 30 for directing the collected formation fluid in an axial direction to one or both of the mechanical fittings 150. In an embodiment, the flow lines 36 are in the form of tubes, and the tubes are connected to the guard drains 34 and the sample drains 32 disposed between the guard drains 34. The tubes maintain separation between the fluids flowing into the guard drains 34 and the sample drains 32, respectively.

Figure 2:
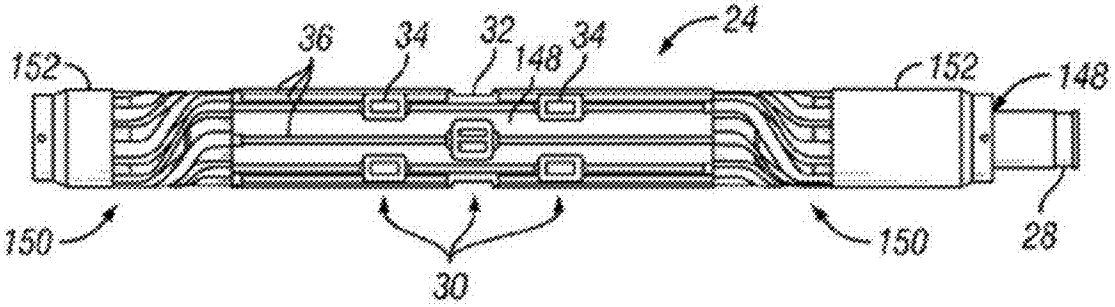
FIG. 2 Prior Art

As illustrated in FIG. 2, the flow lines 36 may be tubes/conduits oriented generally axially along the packer 24. The flow lines 36 extend through the axial ends of the outer flexible skin 26. By way of example, the flow line 36 may be at least partially embedded in the flexible material of the outer flexible skin 26. Consequently, the portions of the flow lines 36 extending along the outer flexible skin 26 move radially outward and radially inward during expansion and contraction of the packer 24. One or more mechanical fittings 150 may have collector portions 152 coupled with a plurality of movable members 154. The movable members 154 are pivotably coupled to each of the collector portions 152 via pivot links for pivotable motion about an axis generally parallel with the packer axis. At least some of the movable members 154 are designed as tubes to transfer fluid received from the flow lines 36, extending along outer flexible skin 26, to collector portions 152. From the collector portions 152, the collected fluids may be transferred/directed to desired collection/testing locations. The pivotable motion of the movable members 154 enable transition of the packer 24 between a contracted state and an expanded state. The movable members 154 may be designed generally as S-shaped members pivotably connected between flow lines in the outer flexible skin 26 and the collector portions 152.

As described above, the packer assembly 20 may be constructed in a variety of configurations for use in many environments and applications. The packer 24 may be constructed from different types of materials and components for collection of formation fluids from single or multiple intervals within a single expansion zone. The flexibility of the outer flexible skin 26 enables use of the packer 24 in many well environments. Furthermore, the various packer components can be constructed from a variety of materials and in a variety of configurations as desired for specific applications and environments.

Figure 3:
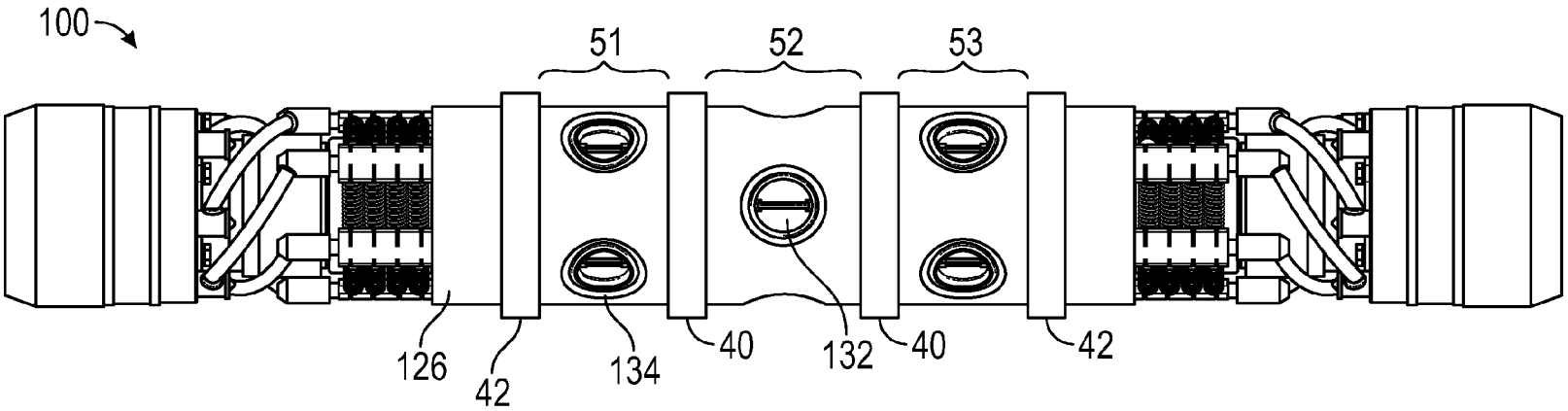
FIG. 3 generally illustrates an example of a packer with expansion rings in accordance with one or more aspects of the present disclosure.

FIG. 3 illustrates a packer 100 with expansion rings 40, 42 in accordance with one or more aspects of the present disclosure. As illustrated, the rings 40, 42 may be formed of thick portions of rubber. The rings 40, 42 may be composed of the same material used to form the outer flexible skin 126. Depending on the application, the packer 100 may have one or more of the rings 40, 42. In the illustrated example, the packer 100 has two of the rings 40 to isolate the sample drains 132. Further, the packer 100 has two of the rings 42 to isolate the guard drains 134.

The rings 40, 42 may isolate different portions of the wellbore during testing. Thus, the rings 40, 42 may be used for focused sampling of specific portions of a wellbore. That is, the packer 100 may be disposed in a wellbore at any depth to test a particular section of that wellbore. Moreover, the rings 40, 42 may enable sampling across a larger surface area. For example, the rings 40, 42 may isolate an entire section of the wellbore. Fluid drawn into the sample drains 32 may be extracted from the entire isolated portion. Thus, the rings 40, 42 enable any size or type of drain to be used. For example, if a small drain is used, a sufficient amount of fluid may be sampled due to the isolation of an entire section of the wellbore using the rings 40, 42.

Further, the rings 40, 42 may improve fluid sampling in tight formations. The rings 40, 42 may create an air-tight seal in the isolated portion of the wellbore. Thus, the packer 100 may create a larger pressure differential to draw fluid from the tight formation. The outer rings 42 isolating the guard drains 134 may focus contaminated fluid into the guard drains 134. Thus, the segregation of non-contaminated fluid and contaminated fluid may be more effectively implemented.

The rings 40, 42 may be provided with the packer 100 and/or may be retrofitted to the packer 100. The rings 40, 42 may be installed and/or removed depending on the formation and/or the desired sampling method. The rings 40, 42 may be permanently affixed to the packer 100 by welding, fasteners, and/or cement. The placement of the rings 40, 42 may also be customized depending on a desired application. For example, in a formation with increased contaminants in the fluid, a larger guard drain section may be desired.

In the illustrated embodiment, the packer 100 has four rings: two inner rings 40 and two outer rings 42. The rings 40, 42 define three contiguous sections 51, 52, 53. The first section 51 and the third section 53 may contain guard drains 134. The second section 52 may contain sample drains 132.

Figure 4:
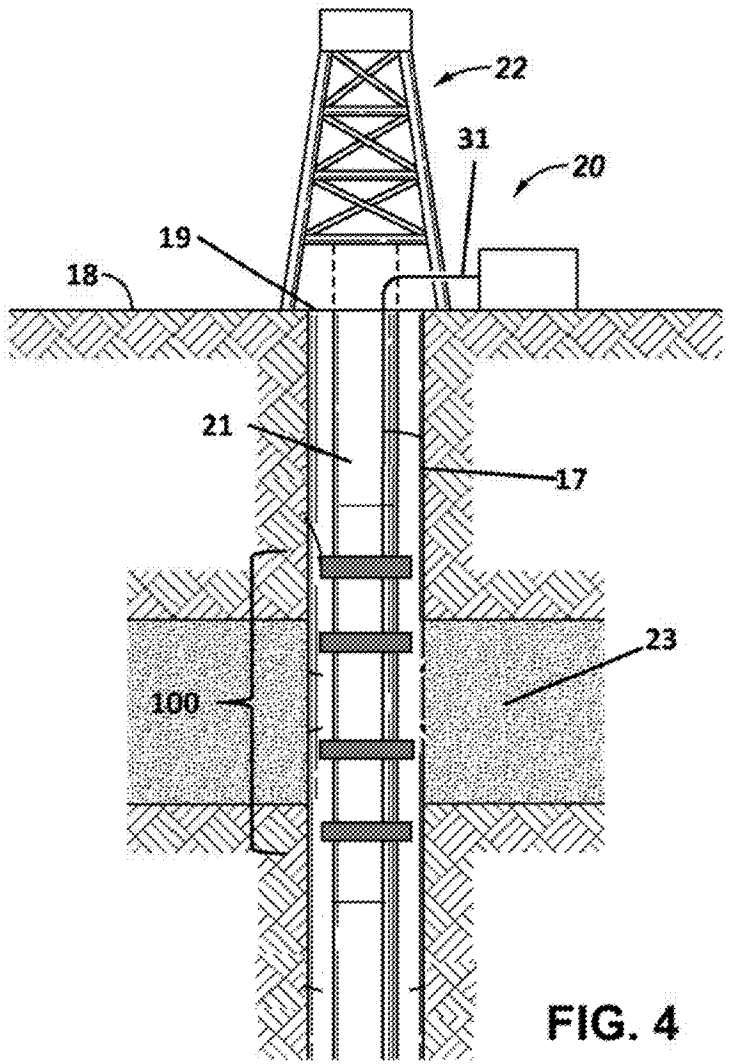
FIG. 4 shows an example of a well system in which one or more embodiments of the present disclosure may be used.

FIG. 4 shows an example of a well system 20 in which one or more embodiments of the present disclosure may be used. In this example, the well system 20 has a rig 22 used to deliver a tool 21 downhole into a wellbore 19. The rig 22 is positioned at a surface location 18, such as a land surface location, from which the wellbore 19 is drilled. Depending on the specific application, the tool 21 may have various components and/or assemblies used in a variety of well related operations. One of the components may be a packer assembly 100 according to one or more embodiments of the present disclosure. As illustrated, the packer assembly 100 is delivered downhole via a well string 31, e.g. a tubing string, to a desired location in the wellbore 19. After lowering the well string 31 into the wellbore 19, the packer assembly 100 is inflated until the outer sealing layer 126 abuts a wall 17 of the wellbore 19. The rings 40, 42 isolate portions of the wellbore 19. Sampling of formation fluid 23 is carried out via the drains 132, 134 of the packer assembly 100.

When deployed and expanded in a wellbore 19, the three sections 51, 52, 53 may enclose three corresponding sections of the wellbore. The rings 40, 42 create a temporary seal between the packer 100 and walls 17 of the wellbore. A pressure differential may be initiated in the packer 100 to draw fluid from the formation 23 into the drains 132, 134.

Figure 5:
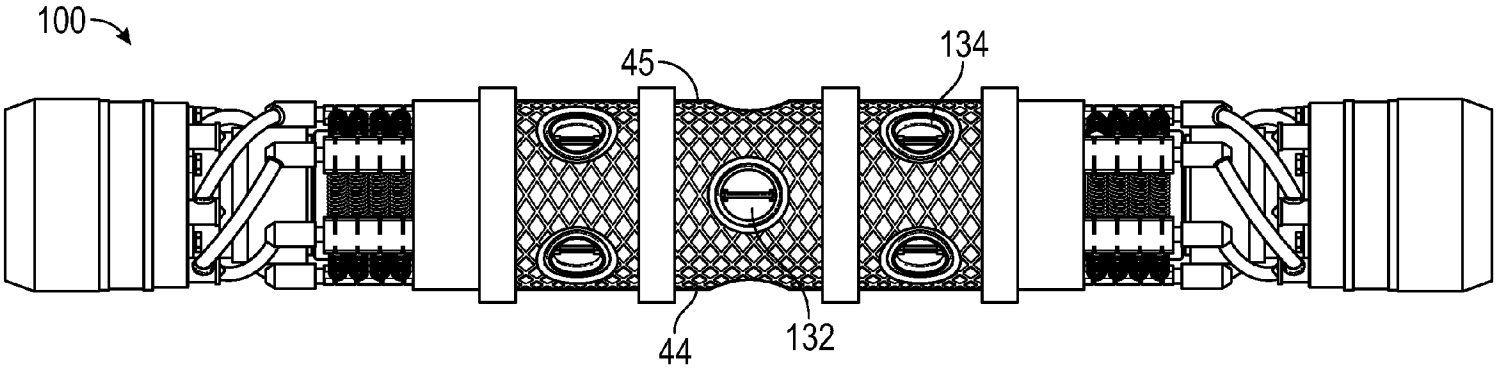
FIG. 5 generally illustrates an example of a packer with a composite outer layer in accordance with one or more aspects of the present disclosure.

FIG. 5 illustrates the packer 100 with an irregular sealing layer 45 in accordance with one or more embodiments. The irregular sealing layer 45 may form grooves in the rubber of the outer diameter of the packer 100. The grooves 44 may create a leak path between the drains 32, 34 of the packer 100. Moreover, when used in embodiments of the packer 100 with the expansion rings 40, 42, the grooves 44 may guide sample fluid into the drains 132, 134 from a sealed portion of the wellbore 19. Thus, in the embodiment with the expansion rings 40, 42, the grooves 44 effectively create one large sampling inlet between each pair of the rings 40, 42. The irregular sealing layer may be used in combination with or without the expansion rings 40, 42.

In practice, when the packer 100 is expanded to abut the walls 17 of the wellbore 19, the outer diameter of the packer 100 is flush against the wall of the wellbore 19. Without the grooves 44, fluid may only be drawn into the drains 132, 134 from that portion of the wall 17 that is directly abutted to the drain 132, 134. However, the grooves 44 create leak paths through which sample fluid may flow. The leak paths formed by the grooves 44 may carry fluid to one or more of the drains 132, 134.

Figure 6:
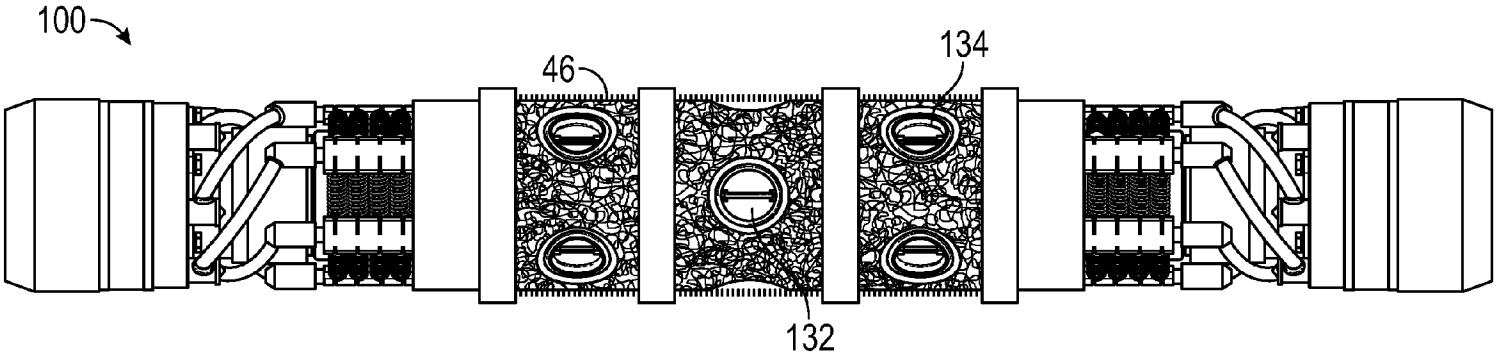
FIG. 6 generally illustrates an example of a packer with an irregular outer layer in accordance with one or more aspects of the present disclosure.

In FIG. 6, the irregular sealing layer 45 may be a composite material 46 composed of technical fibers/textiles and/or plastic. The technical fibers may be a non-aesthetic textile material used to increase strength and provide certain properties depending on the application. Permeable technical fibers, such as geo-textiles, may be used in embodiments. The composite material 46 may be semi-permeable such that fluid may flow through the material, but solids may not flow through the material. Thus, the composite material 46 may prevent contamination of samples. The composite material 46 may also facilitate fluid flow when the outer diameter of the packer 100 is abutted to a formation wall 17.

In the embodiments described above where a component is described as formed of rubber or comprising rubber, the rubber may include an oil resistant rubber, such as NBR (Nitrile Butadiene Rubber), HNBR (Hydrogenated Nitrile Butadiene Rubber) and/or FKM (Fluoroelastomers). In a specific example, the rubber may be a high percentage acrylonytrile HNBR rubber, such as an HNBR rubber having a percentage of acrylonytrile in the range of approximately 21% to approximately 49%. Components suitable for the rubbers described in this paragraph include, but are not limited to, the outer flexible skin 26 and the inflatable bladder 148.

In one embodiment a system for collecting fluid in a wellbore is disclosed comprising an outer flexible skin having an outer diameter, a plurality of rings disposed around the outer diameter, a plurality of drains coupled to the outer flexible skin, and a mandrel positioned within the outer flexible skin. In another embodiment, a method is disclosed comprising deploying a packer assembly into a wellbore wherein the packer assembly inflates toward a wall of the wellbore and has an opening connected to a flow line for receiving fluid and two exterior rings extending around a circumference of the packer assembly; expanding the packer assembly such that the exterior rings abut the wall of the wellbore; isolating a section of the wellbore by creating a seal between the wellbore wall and the exterior rings and obtaining fluid through the opening. In still another embodiment, a sampling tool is disclosed comprising an outer sealing layer having irregularities, a plurality of drains coupled to the outer sealing layer, a flow line connected to an opening for moving the fluid into the packer assembly, and a mandrel positioned within the outer flexible skin.

Although exemplary systems and methods are described in language specific to structural features and/or methodological acts, the subject matter defined in the appended claims is not necessarily limited to the specific features or acts described. Rather, the specific features and acts are disclosed as exemplary forms of implementing the claimed systems, methods, and structures. Accordingly, although only a few embodiments of the present invention have been described in detail above, those of ordinary skill in the art will readily appreciate that many modifications are possible without materially departing from the teachings above.

What is claimed is:

1. A system for collecting fluid in a wellbore comprising:
an outer flexible skin having an outer diameter;
a plurality of rings disposed around the outer diameter;
a plurality of drains embedded into the outer flexible skin, wherein the plurality of drains are configured to move together with the outer flexible skin, and wherein the flexible skin is configured to expand against a surrounding wellbore such that the plurality of rings abut the wall of the surrounding wellbore: and
a mandrel positioned within the outer flexible skin.

2. The system of claim 1, wherein the rings and the outer flexible skin are composed of a same material.

3. The system of claim 1, wherein the rings are disposed above and below one of the plurality of drains.

4. The system of claim 1, further comprising grooves on the outer flexible skin.

5. The system of claim 1, further comprising a semi-permeable composite material on the outer flexible skin.

6. The system of claim 1, wherein four rings define three contiguous sections about the outer diameter.

7. The system of claim 6, wherein a first section and a third section of the three contiguous sections have guard drains, and a second section of the three contiguous sections has a sample drain.

8. A method comprising:
deploying a packer assembly into a wellbore wherein the packer assembly inflates toward a wall of the wellbore and has an opening connected to a flow line for receiving fluid and two exterior rings extending around a circumference of the packer assembly, wherein the opening moves toward the wall when the packer assembly inflates, and wherein the opening is embedded in a flexible skin;
expanding the packer assembly such that the exterior rings abut the wall of the wellbore, and wherein the flexible skin engages the wall of the wellbore;
isolating a section of the wellbore by creating a seal between the wellbore wall and the exterior rings; and
obtaining fluid through the opening.

9. The method of claim 8, wherein the fluid is obtained by creating a pressure differential.

10. The method of claim 8, wherein the packer assembly has additional rings defining sections with guard drains above and below the opening.

11. The method of claim 8, wherein the packer assembly has an irregular sealing layer.

12. The method of claim 11, wherein the irregular sealing layer has grooves.

13. A sampling tool comprising:
an outer sealing layer having irregularities formed in an outer surface of the outer sealing layer;
a plurality of drains embedded into the outer sealing layer, wherein the outer sealing layer is configured to abut a wall of a wellbore;
a flow line connected to an opening for moving the fluid into a packer assembly;
a mandrel positioned within the outer sealing layer; and
a plurality of rubber rings disposed around the outer sealing layer.

14. The sampling tool of claim 13, wherein the outer sealing layer has grooves.

15. The sampling tool of claim 14, wherein the grooves carry fluid to the drains.

16. The sampling tool of claim 13, wherein the outer sealing layer is formed of a composite material.

17. The sampling tool of claim 16, wherein the composite material is semi-permeable and transports fluid to the drains.

18. The sampling tool of claim 16, wherein the composite material has fibers.

19. The sampling tool of claim 13, wherein the rubber rings form a seal with the outer sealing layer such that fluid is restricted from passing between the rubber rings and the outer sealing layer.

* * * * *